United States Patent [19]

Hauschildt et al.

[11] 4,067,798

[45] Jan. 10, 1978

[54] CATALYTIC CRACKING PROCESS

[75] Inventors: Frank William Hauschildt, Naperville, Ill.; Ralph J. Bertolacini, Chesterton, Ind.

[73] Assignee: Standard Oil Company (Indiana), Chicago, Ill.

[21] Appl. No.: 661,654

[22] Filed: Feb. 26, 1976

[51] Int. Cl.[2] ..... C10G 37/02

[52] U.S. Cl. ..... 208/92; 208/61; 208/62; 208/73; 208/74

[58] Field of Search ..... 208/61, 66, 74, 75, 208/76, 77, 92, 62

[56] References Cited

U.S. PATENT DOCUMENTS

| | | | |
|---|---|---|---|
| 2,890,164 | 6/1959 | Woertz | 208/74 |
| 3,714,023 | 1/1973 | Stine | 208/62 |
| 3,761,391 | 9/1973 | Conner | 208/76 |
| 3,776,838 | 12/1973 | Youngblood et al. | 208/74 |
| 3,928,172 | 12/1975 | Davis et al. | 208/77 |
| 3,945,913 | 3/1976 | Brennan et al. | 208/92 |

*Primary Examiner*—Herbert Levine
*Attorney, Agent, or Firm*—Richard A. Kretchmer; Arthur G. Gilkes; William T. McClain

[57] ABSTRACT

A method for catalytically cracking an isolated reactant feed, 80–100 volume percent of which is a substantially mono-aromatic hydrocarbon fraction boiling in the boiling range of heavy gasoline and the remainder of which is a vaporizable hydrocarbon fraction, under effective cracking conditions of cracking temperature, catalyst composition, catalyst activity, catalyst-to-feed weight ratio, and weight hourly space velocity, to produce an isolated product having increased low molecular weight olefin and low molecular weight mono-aromatic contents and a reduced sulfur content and having a high octane rating.

21 Claims, 4 Drawing Figures

CATALYTIC CRACKING PROCESS

BACKGROUND OF THE INVENTION

1. Field of the Invention

This invention is a fluid catalytic cracking process for converting an intermediate boiling point-range hydrocarbon-containing material to more valuable products and, in particular, is a method for producing an isolated catalytic cracking product having increased low molecular weight olefin and mono-aromatic contents and a reduced sulfur content and having a high octane rating, by catalytically cracking an isolated reactant feed, at least 80 volume percent of which is a substantially mono-aromatic hydrocarbon fraction boiling in the boiling range of heavy gasoline and the remainder of which is a vaporizable hydrocarbon fraction.

2. Description of the Prior Art

Since World War II, catalytic cracking has been the primary method for converting heavy components of crude oil into gasoline in the refinery. The product from catalytic cracking has been of suitable quality for direct economical blending to gasoline. However, the trend toward lower sulfur and lead levels in future gasolines has made some form of reprocessing of the product from catalytic cracking necessary. Requirements for additional sources of light olefins for either chemical feedstock or alkylate feedstock and of light aromatics for chemical feedstocks have also made reprocessing desirable.

There have been numerous attempts to reprocess heavy hydrocarbon fractions. For example, Hampton, U.S. Pat. No. 3,758,400 (1973) discloses a process for cracking in one catalytic cracking reactor a hydrocarbon feed oil, including a recycle oil, which is higher boiling than gasoline and which normally boils above about 600° F., and is, in particular, recycled gas oil which was produced in a second catalytic cracking reactor.

Harper, U.S. Pat. No. 2,941,936 (1936) discloses a process which is adapted for the catalytic cracking of different types of hydrocarbons in separate catalytic cracking units, which involves cracking a substantially virgin gas oil in the presence of a catalyts, fractionating the product therefrom to obtain a fraction containing heavy cycle oils and decant oils containing some aromatics, cracking this fraction in the absence of virgin gas oil and in the presence of a catalyst, to thereby produce a product having substantially increased aromatics content, solvent extracting this product in order to obtan therefrom the aromatics therein and to return a raffinate thus obtained from such solvent extracting to the first zone.

Bunn et al., U.S. Pat. No. 3,448,037 (1969) discloses a method for a fluid catalytic cracking of hydrocarbon oils wherein a virgin gas oil and a cracked cycle oil which boils in the range of from about 430° F. to 900° F. and which comprises principally a stream boiling above gasoline, preferably a recycle stock, boiling between about 600° and 800° F. comprising intermediate cycle gas oils, are individually cracked through separate elongated reaction zones with a zeolite cracking catalyst under high conversion conditions, combining the zeolite catalyst from the individual elongated reaction zones into a dense phase fluidized bed and further converting the cracked cycle gas oil effluent in the bed.

Bunn et al., U.S. Pat. No. 3,433,733 (1969) discloses in the discussion of the prior art a process wherein two separate hydrocarbon streams in two separate risers are introduced into the reaction zone, one such hydrocarbon stream comprising a virgin gas oil cracking stock and the second such hydrocarbon stream comprising a stock having substantially different cracking characteristics, for example, a cycle gas oil — such as that separated from the fluid catalytic cracking products — or an extract from the solvent refining of a gas oil.

Rehbein, U.S. Pat. No. 2,827,422 (1958) discloses that it is usually profitable and desirable to recycle in the fluid catalytic cracking process at least a part of the gas oil separated from the product recovered from the fluid catalytic cracking operation and that the optimum recycle rate is about one-half that of the virgin feed oil.

Martin, U.S. Pat. No. 3,649,522 (1972) discloses a process for catalytically cracking a feed made up of fresh gas oil and the recycled product of a recycled fluid catalytic cracking product, with such product being about 30 volume percent of the fresh gas oil feed and having a boiling range, for example, of from about 480° F. to about 750° F.

Woertz, U.S. Pat. No. 2,890,164 (1959) and Hennig, U.S. Pat. No. 3,065,166 (1962) disclose in their discussions of the prior art that intermediate conversion cracking products are separated from the cracked products in a fractionation zone and are recycled back to the incoming charge-oil line where they are mixed directly with either partially reactivated catalyst or catalyst which has been subjected to complete regeneration and that, in still other methods, the intermediate boiling fractions from the cracked products are subjected to cracking in a separate cracking zone using a portion of regenerated catalyst and the products are either transmitted to a common fractionator or separately fractionated. In the method of Woertz, a heavy gasoline fraction boiling in the range of 350°-425° F. or light, recycled gas oil, which is separated from the fluid catalytic cracking products, is separately charged to a hot catalyst transfer line sufficiently far upstream from the point at which fresh feed is charged to the transfer line to accomplish substantial cracking of the heavy gasoline fraction or light, recycled gas oil between the points of feed entry, with about 180 moles of virgin gas oil being injected into the transfer line per hour and about 20 moles of recycle material per hour. The method of Hennig is similar to the method of Woertz but adds the step of separately hydrogenating the heavy gasoline fraction.

Haunschild, U.S. Pat. No. 3,803,024 (1974) discloses a process for catalytically cracking at least a portion of a fraction of fluid catalytic cracking products boiling above a given temperature with a second catalytic cracking catalyst in a second catalytic cracking zone.

Marshall, U.S. Pat. No. 2,921,014 (1960) discloses a method for the conversion of hydrocarbon oil boiling essentially above gasoline wherein the oil to be cracked is contacted in separate and distinct cracking stages under cracking conditions with a solid cracking catalyst and the product is removed by separate fractionation of the hydrocarbon reaction mixture from the separate cracking stages; the hydrocarbon mixture from the first stage of cracking is fractionated to remove as overhead product a hydrocarbon fraction having a final boiling point above about 266° F. but below the final boiling point of the finished motor gasoline; the resulting bottoms product is subjected to further cracking in a subsequent catalytic cracking stage. The disclosed process permits recycle up to several, that is two or more, parts of recycle stock per part of fresh feed without loss in octane number.

McKinney et al., U.S. Pat. No. 3,692,667 (1972) discloses a process for cracking a primary fresh hydrocarbon charge capable of being cracked to lower boiling constituents including petrochemicals and the like in the presence of a stream of fluidized cracking catalyst involving recycling at least a portion of the normally liquid effluent product of the cracking process to the catalyst stream and adding the recycled portion to the catalyst stream at a point having a higher temperature than that at which the fresh charge is added so that a significant proportion of the recycle effluent is cracked by the catalyst. Typically, the recycle includes materials boiling between about 180° F. and about 330° or 375° F. However, distillate fuel oils boiling from about 375° F. to about 430° F. can also be recycled. The quantity of recycle liquid can vary between about 5 and about 45 percent by volume based on the primary fresh hydrocarbon charge.

McDonald, U.S. Pat. No. 3,679,576 (1972) discloses a process for the catalytic cracking of hydrocarbons under fluid catalytic cracking conditions wherein the maximum efficiency is obtained from a catalyst by serially contacting various hydrocarbon feeds with the catalyst in an apparatus providing a plurality of riser reactors connected in series. One feed can be recycled material from other steps in the refining process and may have a boiling range varying over a wide range, for example, 450° to 650° F. for light oils and 650° to 850° F., or even higher, for heavy gas oils.

Reynolds et al., U.S. Pat. No. 3,761,394 (1973) discloses a process for catalytically cracking low octane naphthas with a zeolitic catalytic cracking catalyst wherein useful feedstocks include low octane naphthas from thermocracking or hydrocracking operations boiling in the range of 100° to 450° F.

Thus far, no one has disclosed the process of this invention.

SUMMARY OF THE INVENTION

Figure 1:
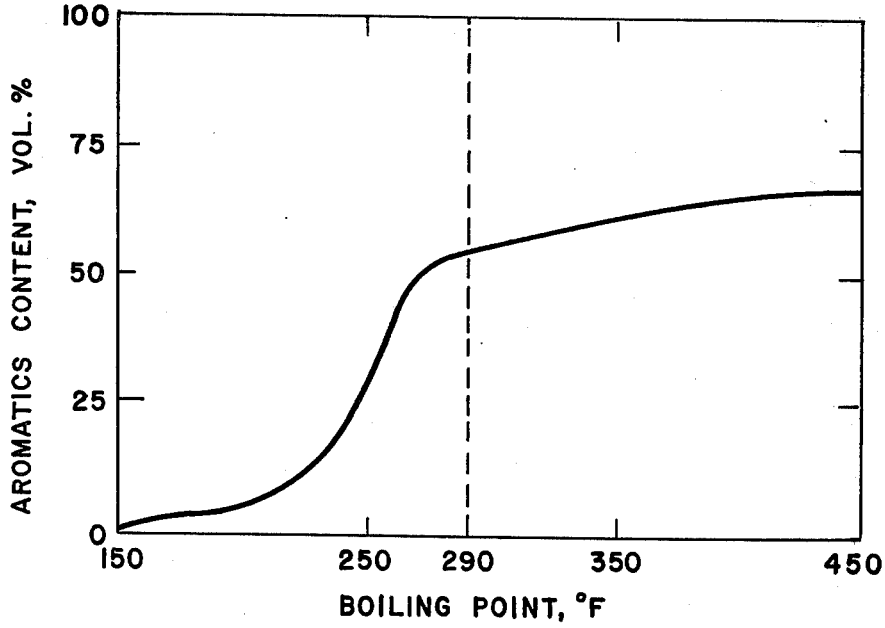
FIGS. 1 and 2 are plots showing the distribution of aromatic compounds and sulfur, respectively, in gasoline.

This invention is an improvement in the process for converting an intermediate boiling-range hydrocarbon material to more valuable products by fluid catalytic cracking. The improvement comprises fractionating at least one material selected from the group consisting of a catalytic cracking product, a thermal cracking product, a reforming product, a hydrocracking product, and mixtures thereof, to separate the portion thereof which is substantially mono-aromatic hydrocarbon fraction boiling in the boiling range of heavy gasoline and catalytically cracking an "isolated" reactant feed, 80–100 volume percent of which is said portion and the remainder of which, if any, is a vaporizable hydrocarbon fraction. The process is carried out in a fluidized catalytic cracking zone and under effective cracking conditions of cracking temperature, cracking catalyst composition, cracking catalyst activity, cracking catalyst-to-hydrocarbon weight ratio and weight-hourly space velocity, to produce an "isolated" product having increased low molecular weight olefin and low molecular weight mono-aromatic contents and a reduced sulfur content and having a high octane rating. In this context, "isolated" means "not in the presence of or not in admixture with another reactant feed and/or product." Such isolation is necessary in order to maximize the upgrading effects of the method of this invention on the products therefrom, before they are used in the desired application.

The fractionated material is preferably a catalytic cracking product. The substantially mono-aromatic hydrocarbon fraction is preferably at least 90 volume percent of said reactant feed and more preferably all of said reactant feed. Mono-aromatic hydrocarbons make up preferably at least 25 and more preferably at least 40 weight percent of the substantially mono-aromatic hydrocarbon fraction. The substantially mono-aromatic hydrocarbon fraction boils preferably in the range of from about 230° F. to about 500° F. and more preferably in the range of from about 300° F. to about 350+ F. The vaporizable hydrocarbon fraction is preferably selected from the group consisting of a gas oil, cycle oil, and mixtures thereof.

Preferably, the cracking temperature is in the range of from about 900° F. to about 1,200° F.; the weight-hourly space velocity is in the range of from about 2 to about 200; the catalyst-to-hydrocarbon weight ratio is in the range of from about 2 to about 25; and the cracking catalyst has a cracking activity of at least about 47 Davision units based on the modified Davision microactivity test, which is described in the Oil and Gas Journal, Nov. 22, 1971, pp. 61–64. More preferably, the cracking temperature is in the range of from about 950° F. to about 1,100° F.; the weight-hourly space velocity is in the range of from about 2 to about 100; the catalyst-to-hydrocarbon weight ratio is in the range of from about 3 to about 15; and the cracking catalyst has a cracking activity of at least about 55 Davision units. Thus, in effect, the cracking catalyst must have a molecular sieve component.

The catalyst employed in the process of this invention contains a molecular sieve or zeolite component with a silica-alumina matrix, wherein preferably alumina is present at a level in the range of from about 13 to about 50 weight percent and the sieve content is in the range of from about 1 to about 15 weight percent. Preferably, the mono-aromatic products from the process of this invention include xylenes and have a low ethylbenzene content, and the olefin products include butene and propylene.

Preferably, this invention includes the steps of separately withdrawing the isolated hyrocarbon product from the fluidized cracking zone.

Preferably, the process includes the additional step of fractionating the product from the cracking step to separate the fraction thereof boiling in the range of from about 280° F. to about 500° F., preferably in the range of from about 300° F. to about 430° F. More preferably, at least a portion of such separated fraction is recycled to the catalytic cracking zone as a part of the substantially mono-aromatic hydrocarbon fraction.

DETAILED DESCRIPTION OF THE INVENTION

A major aspect of this invention is the discovery and appreciation of the differences between the light and heavy gasoline fractions and of the advantages of catalytically cracking the heavy gasoline fraction rather than the light gasoline fraction or a combination of the heavy gasoline fraction with excessive amounts of the light gasoline fraction.

Figure 2:
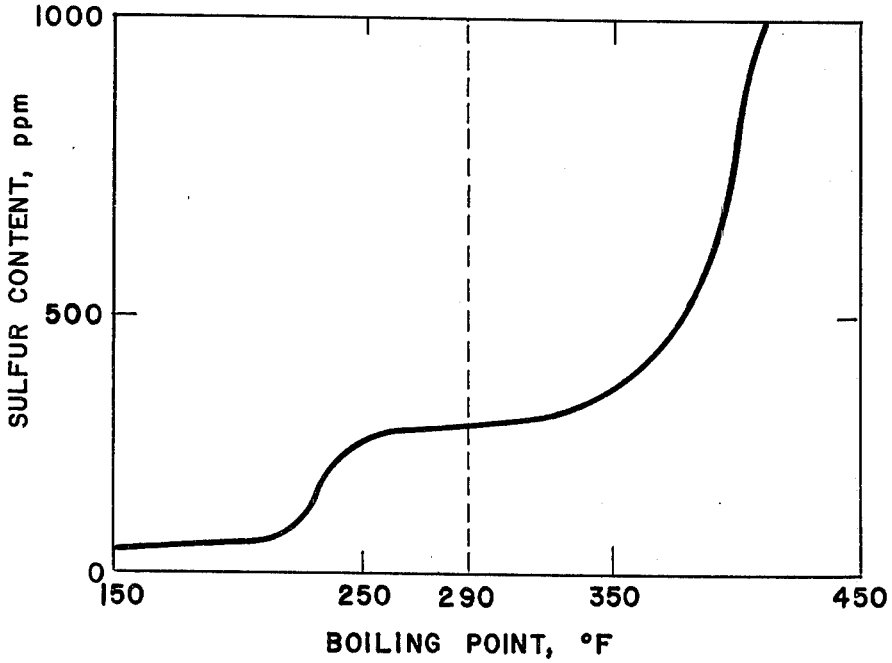

The plots in FIGS. 1 and 2 illustrate that the light and heavy gasoline fractions of fluid catalytic cracking products differ considerably from each other. In each figure, the heavy gasoline fraction is shown to the right of the dashed line. Even though the light gasoline fraction contains all of the benzene, toluene and xylene produced from catalytic cracking, the plot in FIG. 1 illustrates that the light gasoline fraction is essentially non-aromatic in character, while the heavy gasoline fraction is essentially aromatic in character. FIG. 2 illustrates the distribution of sulfur in the light and heavy gasoline fractions of the catalytic cracking products. Comparision of FIGS. 1 and 2 indicates that the distributions of sulfur and of aromatics in the cracking products are similar. This similarity is predictable since more than 90% of the sulfur in the cracking products in the boiling range shown in FIGS. 1 and 2 is either thiophenic or aromatic in character. Thus, as with aromatics, there is little sulfur in the cracking products boiling below 230° F., with a small increase in sulfur concentration and cracked products boiling between 230° F. and 290° F., corresponding to the boiling points of the alkyl thiophenes. Most of the sulfur content is found in the benzothiphenes which are in the fraction boiling above about 350° F. Removal of benzothiophenes causes the greatest problems because of both the high concentration in the heavy gasoline fraction and the low reactivity of benzothiophenes.

The heavy gasoline fraction of catalytic cracking products is the largest source of sulfur in the gasoline pool when this fraction is blended into the gasoline pool. For example, when the heavy gasoline fraction of catalytic cracking products is blended into the gasoline pool, this fraction generally makes up only 10–20 percent of the pool but contains 60–80 percent of the sulfur found in the pool. Further, with regard to octane rating, the light gasoline fraction produced by catalytic cracking has a relatively good octane of 82 motor clear, despite its relatively low aromatic content. The non-aromatic portion of this light gasoline fraction has a relatively high octane of 77 motor clear. However, the heavy gasoline fraction of the cracking products has a relatively low octane of 75 motor clear, despite its relatively high aromatics content. The non-aromatic portion of this heavy gasoline fraction has relatively low octane of 45 motor clear. Therefore, upgrading the heavy gasoline fraction would be more effective in lowering the sulfur content and in raising the octane rating of the gasoline pool than upgrading the light gasoline fraction.

With regard to the heavy gasoline fraction of the cracked products, cracking the sulfur-containing compounds, cracking the low-octane normal paraffins to less dense, higher octane hydrocarbons, and dealkylation and transalkylation of the aromatics to produce benzene, toluene, and xylene are the necessary reactions to provide an increase in gasoline octane and in chemical feedstock supply of benzene, toluene, xylenes and light olefins and a decrease in sulfur content. It has been found that such reactions require at least moderately severe cracking conditions in the method of this invention.

The reaction taking place under the least severe cracking conditions is the cracking of olefins and branched olefins. The reactions requiring greater reaction severity are the cracking of the normal paraffins and the dealkylation and transalkylation of the aromatics. When less severe cracking conditions are employed, the desired results are not obtained. However, even when the reaction severity is high, if the heavy gasoline fraction is cracked in the presence of excessive amounts of gas oil or heavier material, the gas oil or heavier material is preferentially cracked before the desired reactions involving the heavy gasoline fraction take place, and the desired results are not achieved. Further, the effective activity of the catalyst for cracking the heavy gasoline fraction is greatly reduced due to greater catalyst deactivation by coke formation during the cracking of gas oil or heavier material. Consequently, it has been found that the heavy gasoline fraction must make up at least 80 volume percent of the feed in the present invention in order to achieve the desired results.

Figure 3:
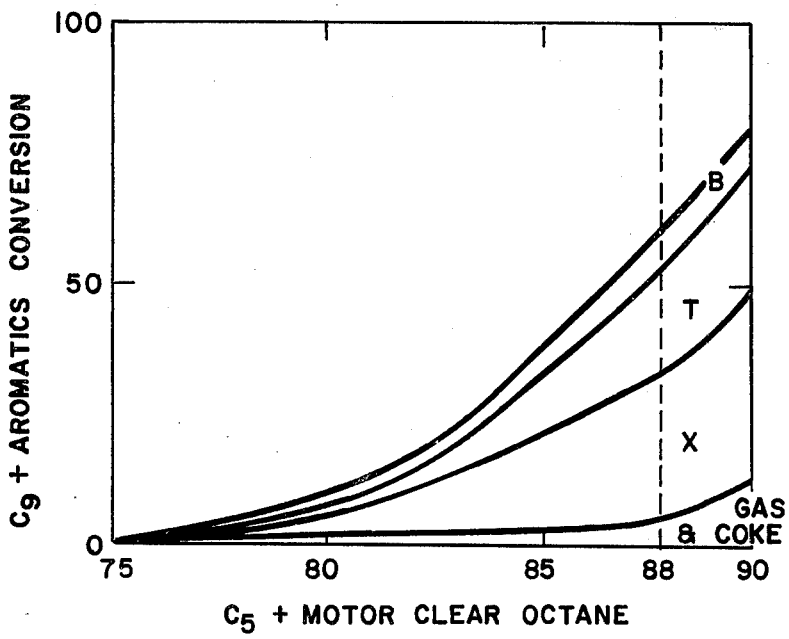
FIGS. 3 and 4 are plots showing the composition of products from cracking aromatic compounds and non-aromatic compounds, respectively, in the heavy gasoline fraction.

For example, in this invention increases in the yields of benzene, toluene, and xylenes are due to the conversion of aromatic compounds containing nine carbon atoms or more by both dealkylation and transalkylation. Such dealkylation involves primarily the removal of ethyl and larger alkyl groups from the aromatic compounds. The product distribution for the conversion by the method of this invention of aromatic compounds in the heavy gasoline fraction and containing nine or more carbon atoms is shown in the plot in FIG. 3 wherein the heavy gasoline fraction is obtained from catalytic cracking. In FIG. 3, the percent conversion of aromatic compounds containing nine or more carbon atoms ($C_9+$) is plotted against the motor clear octane of the product fraction boiling between 93° F. and 430° F. ($C_5+$). The $C_5+$ motor clear octane is a function of the particular reaction severity employed and the particular feed which is cracked. The $C_5+$ motor clear octane increases with the reaction severity when a particular feed is cracked and therefore can be used as an indication of reaction severity when a particular feed is cracked.

The plot in FIG. 3 illustrates that little conversion of the $C_9+$ aromatic compounds in the heavy gasoline fraction occurs in this invention below 80 $C_5+$ motor clear octane. This percent conversion is typical of the conversion of the heavy gasoline fraction attainable at a particular reaction severity when four parts by volume of the heavy gasoline fraction are cracked in the presence of more than one part by volume of gas oil or heavier material. The dashed line in FIG. 3 indicates the $C_9+$ aromatics conversion and $C_5+$ motor clear octane attainable at the same particular reaction severity and when the feed is made up of the heavy gasoline fraction alone. At this point, cracking of the heavy gasoline fraction has increased the yield of xylenes produced by catalytic cracking by approximately 70 percent.

Therefore, by cracking the heavy gasoline fraction in the presence of smaller relative amounts of gas oil or heavier material but at the same particular reaction severity, a $C_5+$ motor clear octane greater than 80 is attained, and the $C_9+$ aromatics percent conversion increases rapidly as the $C_5+$ motor clear octane increases — that is, as the reaction severity increases — with most of the additional product produced being xylenes. The yield of toluene increases somewhat as the reaction severity increases, while the yields of benzene, gas, and coke remain small. The yield distribution and the high selectivity to xylenes production is controlled by the transalkylation reactions. Further recycling of the heavy gasoline fraction provides further increases in the yield of xylenes.

Figure 4:
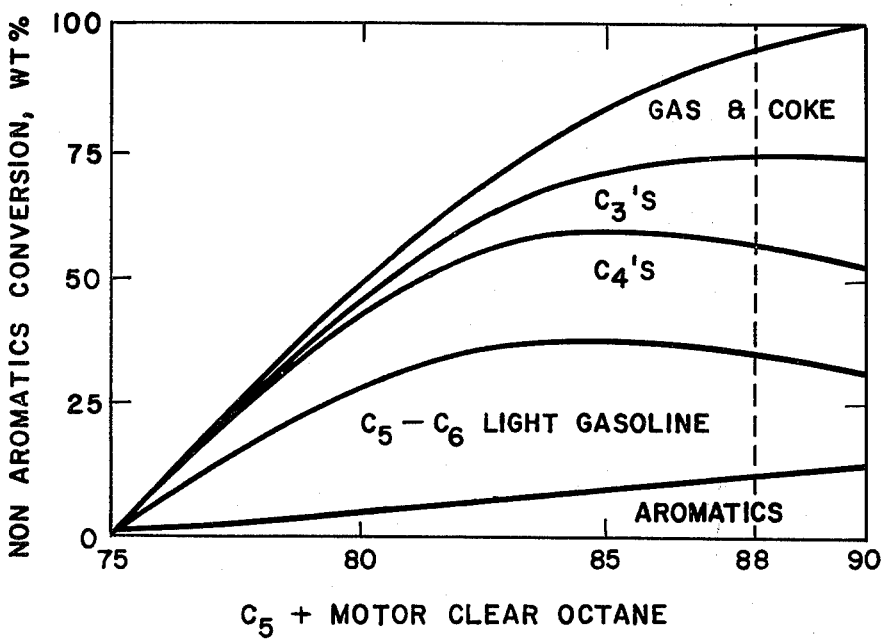

Octane upgrading is accomplished in this invention primarily by cracking the low octane, non-aromatic compounds in the heavy gasoline fraction. The normal paraffinic compounds have the lowest octane of these non-aromatic compounds in the heavy gasoline fraction, and their cracking provides the largest contribution to octane upgrading. The non-aromatic compounds containing nine or more carbon atoms are cracked to form lighter, more-valuable, non-aromatic compounds, with aromatic compounds, gas, and coke being secondary products. The product distribution for the conversion of non-aromatic compounds in the heavy gasoline fraction and containing nine or more carbon atoms in this invention is shown in the plot in FIG. 4. In FIG. 4, the percent conversion of non-aromatic compounds containing nine or more carbon atoms is plotted against the motor clear octane of the product fraction boiling between 93° F. and 430° F. ($C_5+$). The $C_5+$ motor clear octane is a function of the particular reaction severity employed and the particular feed which is cracked. The $C_5+$ motor clear octane increases with the reaction severity when a particular feedstock is cracked and therefore can be used as in indication of reaction severity when a particular feed is cracked.

The plot in FIG. 4 illustrates that relatively low conversion of the non-aromatic compounds in the heavy gasoline fraction occurs in this invention at 80 $C_5+$ motor clear octane. This percent conversion is typical of the conversion of the heavy gasoline fraction attainable at a particular reaction severity when 4 parts by volume of the heavy gasoline fraction are cracked in the presence of more than 1 part by volume of gas oil or heavier material. The dashed line in FIG. 4 indicates the non-aromatics conversion and $C_5+$ motor clear octane attainable at the same particular reaction severity and when the feed is made up of the heavy gasoline fraction alone. At this point, cracking of the heavy gasoline has approximately doubled the yields of the $C_6$-$C_8$ mono-aromatic compounds from gas oil catalytic cracking, with substantially increased yields of light non-aromatic compounds. The lighter, non-aromatic products are primarily olefinic materials, of which approximately two-thirds of the fraction of compounds containing three carbon atoms ($C_3$) is made up of propylene, and of which approximately one-half of the fraction of compounds containing four carbons ($C_4$) is made up of butylenes. The isobutane and butylenes in this fraction are in balance for alkylation. In addition, the light olefins produced can be used as chemical feedstocks. The light gasoline fraction produced is made up mostly of non-aromatic compounds containing five ($C_5$) or six ($C_6$) carbon atoms. Even though the $C_5+$ motor clear octane increases, the yield of the light gasoline fraction decreases at higher reaction severities, due probably to the cracking of compounds containing six carbon atoms to compounds containing three carbon atoms and gas and to the condensation to coke.

In the method of this invention, desulfurization of the heavy gasoline fraction is accomplished both by cracking to form hydrogen sulfide and by transalkylation of the benzothiophenes to heavier compounds. Cracking accounts for somewhat less than half of the desulfurization, with about 43% of the feed sulfur appearing as hydrogen sulfide. Most of the remaining sulfur is concentrated within the polycyclic aromatic fraction of the product, which fraction is not conventionally blended into the gasoline pool. The sulfur concentrated within the polycyclic aromatics fraction includes both the very heavy sulfur compounds that are orginally present in the heavy gasoline fraction and that cannot be cracked and the heavier products whch are formed by transalkylation of benzothiophene with other alkylaromatics. This fraction is not conventionally blended into the gasoline pool. Thus, part of the effective desulfurization in this method is achieved by transalkylation of benzothiophene to form higher boiling materials which are not added to the gasoline pool. Coke accounts for a relatively modest 10% of the feed sulfur, and only 12% of the feed sulfur remains in that portion of the liquid product from the process of this invention, which is to be blended into the gasoline pool. Hence, this method permits removal of about 88% of the sulfur in the portion which is blended in the gasoline pool.

Due to the desulfurization and octane improvement achieved by the process of this invention, the final product therefrom is of such high quality that it can be used directly to make premium gasoline without further processing.

EXAMPLES 1-9

Examples 1-9 are merely illustrative and do not limit the scope of this invention. The experimental conditions employed and the results obtained in Examples 1-9 are listed in Table 1. The compositions of the feeds employed in Examples 1-9 are also described in Table 1. In each example, the feed was a substantially mono-aromatic hydrocarbon fraction, at least 25 weight percent of which was made up of mono-aromatic hydrocarbons and which was obtained by fractionating a product from the catalytic cracking of a gas oil. The boiling range and composition of the feed used in a particular example is presented in the column with the heading of "feed" which is nearest and to the left of the column containing the conditions and results of that particular example. All compositions are reported as weight percents, based on the weight of the particular feed used.

Under "Stream composition" in Table 1, the combined weight percents of hydrogen, hydrogen sulfide, methane, ethane, and ethylene are reported as "Gas;" the aliphatics and cycloaliphatic compounds are designated by the letter "C;" the aromatic compounds are designated by the letter "A/" the "iso-" and "normal-" aliphatics are denoted by prefixes "*i*" and "*n*", respectively; the number of carbon atoms in a compound or groups of compounds is indicated by subscript; when olefinic compounds are reported separately as olefins, the "=" is used to indicate such unsaturation; the combined weight percents of n-butane and of butenes are reported as "$nC_4 + C_4=$;" the combined weight percents of aliphatic and cycloaliphatic compounds having 5-7 carbon atoms, with the exception of isopentane, are reported as "$nC_5$-$C_7=$;" the combined weight percents of aliphatic and cycloaliphatic compounds having 10-12 carbon atoms are reported as "$C_{10-12}$;" the weight percent of product boiling at 430° F. and above is reported as "430° F.+;" and the weight percent of coke formed on the cracking catalyst is reported as "coke." The sulfur content is reported as the weight percents of sulfur in various boiling ranges, more particularly as the weight percents of sulfur in specific types of compounds in such boiling ranges, as the total weight percent of sulfur in the total liquid fraction, and as the total weight percent of sulfur as hydrogen sulfide and in coke. The motor octane number (MON) clear and research octane number (RON) clear are reported for each feed and liquid product.

TABLE 1

| Example | | 1 | 2 | 3 | | 4 |
|---|---|---|---|---|---|---|
| Stream | feed | product | product | product | feed | product |
| Boiling point range, ° F. | 230–475 | | | | 100–475 | |
| Cracking catalyst activity[1] | — | 45 | 73 | 73 | — | 73 |
| Unit cracking severity: | | | | | | |
| Cracking temperature, ° F. | — | 1000 | 1000 | 1025 | — | 1000 |
| Cracking catalyst-to-oil weight ratio | — | 5 | 17.6 | 14.5 | — | 13 |
| Weight hourly space velocity[2] | — | 10 | 22 | 27 | — | 53 |
| Feed Rate[3] | — | .008 | 18.6 | 18.7 | — | 18.4 |
| Stream composition:[4] | | | | | | |
| Gas | 0 | 1.2 | 2.0 | 2.4 | 0 | 1.1 |
| $C_3$ | 0 | 1.5 | 2.1 | 2.5 | 0 | 1.3 |
| $C_3=$ | 0 | 2.9 | 4.3 | 5.1 | 0 | 4.4 |
| i $C_4$ | 0 | 4.3 | 5.5 | 5.9 | 0 | 5.0 |
| n $C_4$ + $C_4=$ | 0 | 4.3 | 4.3 | 4.8 | 0 | 4.7 |
| i $C_5$ | 0 | 7.6 | 5.7 | 5.4 | 1.0 | 6.6 |
| n $C_5$—$C_7$ | 0.6 | 5.8 | 8.0 | 6.8 | 23.0 | 19.7 |
| $A_6$ | 0 | .9 | 1.3 | 1.8 | 1.3 | 1.4 |
| $A_7$ | 1.3 | 9.0 | 5.4 | 6.1 | 3.1 | 6.0 |
| $C_8$ | 4.2 | | 3.5 | 2.8 | 10.8 | 4.4 |
| $A_8$ | 11.3 | 21.6 | 17.5 | 17.6 | 8.4 | 13.1 |
| $C_9$ | 14.4 | | 2.2 | 1.4 | 6.8 | 1.4 |
| $A_9$ | 12.9 | 24.3 | 14.1 | 14.1 | 10.5 | 10.7 |
| $C_{10}$—$C_{12}$ | 19.6 | | 1.8 | 1.8 | 17.4 | 1.8 |
| $A_{10}$ | 17.3 | 6.9 | 7.6 | 7.7 | 14.5 | 9.1 |
| 430+° F+ | 18.1 | 8.5 | 10.9 | 10.2 | 3.2 | 6.9 |
| coke | 0 | 1.2 | 3.8 | 3.6 | 0 | 2.4 |
| Sulfur distribution: | | | | | | |
| gasoline boiling range: | | | | | | |
| sulfides and mercaptans | .023 | 0 | 0 | 0 | | |
| thiophene and its derivatives | .041 | .017 | .007 | .018 | | |
| benzothiophene | .042 | .032 | .016 | .016 | | |
| cycle oil boiling range: | | | | | | |
| alkyl-benzothiophene | .160 | .196 | .092 | .071 | | |
| dibenzothiophene and its derivatives | .004 | .025 | .010 | .028 | | |
| total liquid fraction | .270 | .270 | .125 | .133 | | |
| $H_2S$ and coke | 0 | 0 | .145 | .137 | | |
| RON Clear (5) | 83.0 | | 96.4 | 97.1 | 89.6 | 91.4 |
| MON Clear (5) | 72.9 | | 86.7 | 87.8 | 76.9 | 81.2 |

| Example | | 5 | 6 | 7 | 8 | 9 |
|---|---|---|---|---|---|---|
| Stream | feed | product | product | product | product | product |
| Boiling point range, ° F. | 280–480 | | | | | |
| Cracking catalyst activity[1] | — | 71 | 71 | 71 | 71 | 71 |
| Unit cracking severity: | | | | | | |
| Cracking temperature, ° F. | — | 925 | 995 | 975 | 1000 | 1000 |
| Cracking catalyst-to-oil weight ratio | — | 2.3 | 5.1 | 9.2 | 8.3 | 4.2 |
| Weight hourly space velocity[2] | — | 7.6 | 7.9 | 7.5 | 7.3 | 18.3 |
| Feed Rate[3] | — | 1.2 | 1.2 | 1.2 | 1.2 | 3.0 |
| Stream composition:[4] | | | | | | |
| Gas | 0 | 2.7 | 3.3 | 2.4 | 3.5 | 1.7 |
| $C_3$ | 0 | 0.9 | 1.5 | 1.3 | 1.6 | 1.1 |
| $C_3=$ | 0 | 2.7 | 4.4 | 3.7 | 4.9 | 3.4 |
| i $C_4$ | 0 | 4.6 | 5.2 | 4.0 | 4.9 | 3.2 |
| n $C_4$ + $C_4=$ | 0 | 5.2 | 6.3 | 4.8 | 6.0 | 3.9 |
| i $C_5$ | 0 | 8.4 | 8.8 | 4.9 | 7.2 | 4.8 |
| n $C_5$—$C_7$ | 0 | 1.3 | 1.2 | 1.6 | 3.8 | 1.6 |
| $A_6$ | 0 | 0.7 | 1.0 | 0.6 | 0.8 | 0.6 |
| $A_7$ | 0 | 2.6 | 5.3 | 3.4 | 4.6 | 2.8 |
| $C_8$ | 0 | 1.4 | 0.1 | 0.2 | 0.2 | 0.7 |
| $A_8$ | 3.8 | 10.0 | 12.4 | 15.1 | 15.3 | 12.2 |
| $C_9$ | 0.8 | 2.3 | 1.5 | 1.8 | 1.5 | 2.4 |
| $A_9$ | 17.8 | 19.3 | 17.5 | 20.7 | 18.8 | 21.7 |
| $C_{10}$—$C_{12}$ | 27.2 | 7.2 | 4.5 | 5.8 | 4.6 | 7.7 |
| $A_{10}$ | 28.0 | 18.3 | 12.7 | 14.1 | 11.8 | 19.1 |
| 430+° F+ | 17.9 | 6.5 | 8.7 | 9.4 | 7.5 | 7.5 |
| coke | 0 | 1.0 | 2.9 | 3.1 | 3.2 | 1.7 |
| Sulfur distribution: | | | | | | |
| gasoline boiling range: | | | | | | |
| sulfides and mercaptans | 0.40 | 0 | 0 | 0 | 0 | 0 |
| thiophene and its derivatives | .014 | .005 | .007 | .006 | .076 | .014 |
| benzothiophene | .052 | .019 | .024 | .016 | .017 | .018 |

TABLE 1-continued

| | | | | | | |
|---|---|---|---|---|---|---|
| cycle oil boiling range: | | | | | | |
| alkyl-benzothiophene | .149 | .133 | .110 | .104 | .098 | .122 |
| dibenzothiophene and its derivatives | .015 | .012 | .010 | .004 | .003 | .002 |
| total liquid fraction | .270 | .169 | .151 | .130 | .184 | .156 |
| $H_2S$ and coke | 0 | .101 | .119 | .140 | .086 | .114 |
| RON Clear[5] | 85.0 | 94.9 | 97.5 | 99.3 | 99.5 | 97.0 |
| MON Clear[5] | 75.2 | 83.1 | 86.1 | 86.5 | 86.7 | 84.4 |

Footnotes
[1]Davison units, based on the Davison modified microactivity test, described in the Oil and Gas Journal, November 22, 1971, pp. 61-64.
[2]Hours [1].
[3]Pounds per hour.
[4]Weight percent, based on the weight of the feed.
[5]Octane numbers of $C_5$-430° F fraction of product.

The cracking catalyst employed in Example 1 was a fresh commercially available cracking catalyst containing crystalline aluminosilicate (molecular sieve or zeolite) component and a silica-alumina matrix, that was severely steamed (1500° F, 5 hours). After steaming the catalyst contained about 65 weight percent of silica, about 30 weight percent of alumina and about 5% of molecular sieve. The cracking catalyst employed in Examples 2–4 was an equilibrium, commercially available cracking catalyst containing a crystalline aluminosilicate (molecular sieve or zeolite) component and a silica-alumina matrix, containing about 65 weight percent of silica, about 30 weight percent of alumina, and about 5 weight percent of the molecular sieve, based on total catalyst weight. The cracking catalyst employed in Examples 5–9 was also an equilibrium, commercially available cracking catalyst containing a crystalline aluminosilicate (molecular sieve or zeolite) component and a silica-alumina matrix, containing, however, about 38 weight percent of silica, about 57 weight percent of alumina, and about 5 weight percent of the molecular sieve, based on the total catalyst weight. The activities of these three catalysts were measured using the Amoco RMA (relative microactivity) microactivity test and were found to be 80, 143, and 136 RMA, respectively, which are approximately equal to 45, 73, and 71 Davison units, based on the Davision microactivity test and presented in Table 1.

The conditions and fixed-bed, bench-scale cracking unit employed in Example 1 were very similar to those employed in the modifed Davison microactivity test, which is described in The Oil and Gas Journal, Nov. 22, 1971, pp. 61–64. The cracking unit employed in Examples 2–4 was a fluidized bed pilot plant, which is described in Herring, Hinman, and Shields, "Automated Catalytic Cracking Pilot Plant," *Chem. Eng. Progr.*, Vol. 59, No. 6, June 1963, p. 38. The cracking unit employed in Examples 5–9 was a version of the fluidized bed cracking unit described in U.S. Pat. No. 3,502,574 which had undergone extensive modification so as to operate under conditions characteristic of a commercial fluidized cracking unit.

Examples 1 and 4 are comparative examples which demonstrate the disadvantages of employing a cracking catalyst having insufficient activity and feed having too wide a boiling range, respectively. Comparison of the results in Table 1 indicate that the use of a cracking catalyst having a relatively low activity in Example 1 results in no desulfurization of the liquid product and that conditions providing a relatively high cracking severity of the cracking unit but a relatively low cracking catalyst activity are inadequate and cannot be used in the method of this invention. Further, comparison of the results in Table 1 indicate that use of a heavy gasoline feed having a boiling range outside of the boiling range used in the method of this invention results in a low relative increase in the octane rating of the liquid product, in relatively small degrees of conversion of some of the undesirable components of the feed, and in relatively small increases in the yields of some of the desired components of the final product. The conditions used in Examples 2–3 and shown in Table 1 illustrate that the required unit cracking severity can be achieved by varying a variety of variables. The results for Examples 5–9 demonstrate the effect of differences in cracking catalyst activity and cracking unit severity on the relative increase in octane rating and relative degree of desulfurization of the product and relative degree of cracking of the heavier aliphatic compounds ($C_8$-$C_{12}$) in the feed.

We claim:

1. A process for converting an intermediate boiling-range hydrocarbon fraction to more valuable products by fluid catalytic cracking which comprises:

a. fractionating a catalytic cracking product to separate therefrom a hydrocarbon fraction consisting of at least 40 weight percent of mono-aromatic hydrocarbons and boiling in the range from about 230° F. to about 500° F., b. preparing an isolated feed, 80 to 100 volume percent of which is the fraction from step (a) and the remainder of which is a vaporizable hydrocarbon fraction;

c. catalytically cracking said isolated feed in a fluidized catalytic cracking zone under effective cracking conditions in the presence of a molecular sieve-type cracking catalyst having an equilibrium cracking activity of at least about 55 units on the Davision microactivity scale to produce an isolated hydrocarbon product; and d. recovering said isolated hydrocarbon product from the cracking zone, said isolated hydrocarbon product having increased low molecular weight olefin and low molecular weight mono-aromatic contents, a substantially reduced sulfur content, and a high octane rating relative to said isolated feed.

2. The process as set forth in claim 1 wherein said product is fractonated to separate therefrom a hydrocarbon fraction having a gasoline boiling range and having a substantially increased octane rating relative to said feed.

3. The process as set forth in claim 2 wherein the sulfur content of said hydrocarbon fraction having a gasoline boiling range is reduced by about 80% relative to said feed.

4. The process as set forth in claim 2 wherein said gasoline boiling range is from 93° F. to 430° F.

5. The process as set forth in claim 1 wherein the sulfur content of said isolated hydrocarbon product is reduced by about 40% relative to said feed.

6. The process as set forth in claim 1 wherein at least 90 volume per cent of said isolated feed is the fraction from step (a).

7. The process as set forth in claim 1 wherein all of said isolated feed is said fraction from step (a).

8. The process as set forth in claim 1 wherein said fraction from step (a) boils in the range from about 300° F. to about 450° F.

9. The process as set forth in claim 1 wherein said vaporizable hydrocarbon fraction is selected from the group consisting of a gas oil, cycle oil, and mixtures thereof.

10. The process as set forth in claim 1 wherein the weight-hourly-space velocity is in the range of from about 2 to about 200.

11. The process as set forth in claim 1 wherein the weight-hourly-space velocity is in the range of from about 2 to about 100.

12. The process as set forth in claim 1 wherein the catalyst-to-hydrocarbon weight ratio is in the range of from about 2 to about 25.

13. The process as set forth in claim 1 wherein the catalyst-to-hydrocarbon weight ratio is in the range of from about 3 to about 15.

14. The process as set forth in claim 1 wherein the cracking temperature is in the range of from about 900° F. to about 1,200° F.

15. The process as set forth in claim 1 wherein the cracking temperature is in the range of from about 950° F. to about 1,100° F.

16. The process as set forth in claim 1 wherein said molecular sieve-type cracking catalyst contains from about 13 to about 50 weight percent of alumina.

17. The process as set forth in claim 1 wherein the molecular sieve content of said catalyst is in the range of from about 1 to about 15 weight percent.

18. The process as set forth in claim 1 wherein said isolated hydrocarbon product contains an increased content of xylenes relative to said isolated feed.

19. The process as set forth in claim 1 wherein said isolated hydrocarbon product contains an increased content of butenes and propylene relative to said isolated feed.

20. The process as set forth in claim 1 wherein said isolated hydrocarbon product is fractionated to separate the fraction thereof boiling in the range of from about 280° F. to about 500° F.

21. The process as set forth in claim 20 wherein at least a portion of said separated fraction is recycled to the catalytic cracking zone as part of the mono-aromatic containing hydrocarbon fraction from step (a).

* * * * *

UNITED STATES PATENT OFFICE

CERTIFICATE OF CORRECTION

Patent No. 4,067,798 Dated January 10, 1978

Inventor(s) Frank William Hauschildt and Ralph J. Bertolacini

It is certified that error appears in the above-identified patent and that said Letters Patent are hereby corrected as shown below:

| Column | Line | |
|---|---|---|
| 1 | 40 | "(1936)" should read --(1960)--; |
| 1 | 51 | "obtan" should read --obtain--. |
| 4 | 21 | "350+ F" should read --$450^{o}$ F--. |
| 7 | 26 | "in" should read --an--. |
| 8 | 48 | "A/" should read --A;--. |

Column 11, footnote 2 in Table 1, "$Hours^{1}$" should read --$Hours^{-1}$--.

Signed and Sealed this

Thirtieth Day of October 1979

[SEAL]

Attest:

RUTH C. MASON
Attesting Officer

LUTRELLE F. PARKER
Acting Commissioner of Patents and Trademarks